US005611707A

United States Patent [19]

Meynier

[11] Patent Number: 5,611,707

[45] Date of Patent: Mar. 18, 1997

[54] MICROMINIATURE COAXIAL CONNECTOR WHICH LOCKS BY SNAP-FASTENING

[75] Inventor: Christophe Meynier, Saint Egreve, France

[73] Assignee: Radiall, Rosny-Sous-Bois, France

[21] Appl. No.: 371,507

[22] Filed: Jan. 11, 1995

[30] Foreign Application Priority Data

Jan. 13, 1994 [FR] France ..... 94 00312

[51] Int. Cl.[6] ..... H01R 13/627

[52] U.S. Cl. ..... 439/353; 439/607

[58] Field of Search ..... 439/350, 353, 439/578, 583, 584, 585, 607, 608, 610

[56] References Cited

U.S. PATENT DOCUMENTS

| | | | |
|---|---|---|---|
| 2,877,437 | 3/1959 | Flanagan, Jr. | 439/353 |
| 3,525,973 | 8/1970 | Kipnes | 439/353 |
| 4,580,862 | 4/1986 | Johnson | 439/585 |
| 5,074,809 | 12/1991 | Rousseau | 439/578 |

FOREIGN PATENT DOCUMENTS

| | | |
|---|---|---|
| 0116157 | 8/1984 | European Pat. Off. . |
| 0135299 | 3/1985 | European Pat. Off. . |
| 1111347 | 4/1968 | United Kingdom . |
| 2139018 | 10/1984 | United Kingdom . |

*Primary Examiner*—Hien Vu
*Attorney, Agent, or Firm*—Schweitzer Cornman & Gross

[57] ABSTRACT

A microminiature coaxial connector which locks by snap-fastening, said microminiature coaxial connector including two complementary connector elements, each of said connector elements comprising a hollow cylindrical body forming an exterior earthing contact, said body having a forward end and an interior wall, each of said connector elements further having, starting from said forward end, a cavity into which there penetrates a central contact, said central contact having an end, said two connector elements respectively having male and female central contacts, retained in the body via an insulating material, a first of the connector elements including, inside its body, an elastic socket surrounding its central contact and extending beyond the forward end of the body, said socket having a free end and including, close to its free end, substantially in line with the end of the central contact which it surrounds, a peripheral bead able to engage in a groove formed in the interior wall of the body of the second connector element, wherein the second connector element includes a cylindrical skirt forcibly fitted into its cavity, said skirt having an interior wall and an end and said skirt extending beyond the forward end of said body, the end of said skirt being at a distance (d2) from the end of the central contact of the said second connector element substantially equal to the distance (d1) between the end of the body of the first connector element and the end of the central contact housed within this body.

5 Claims, 3 Drawing Sheets

MICROMINIATURE COAXIAL CONNECTOR WHICH LOCKS BY SNAP-FASTENING

BACKGROUND OF THE INVENTION

The present invention relates to a microminiature coaxial connector which locks by snap-fastening, including two complementary connector elements each comprising a hollow cylindrical body forming an exterior earthing contact and, starting from its forward end, having a cavity into which there penetrates a central contact, respectively a male one and a female one, retained in the body via an insulator, a first of the connector elements including, inside its body, an elastic socket surrounding the central contact and extending beyond the forward end of the body, the said elastic socket including, close to its free end, substantially in line with the end of the central contact which it surrounds, a peripheral bead able to engage in a groove formed in the interior wall of the body of the second connector element.

Owing to the very small dimensions of the connectors in question, of which the bodies, forming exterior contacts, have a diameter of the order of 3 mm, the components of these connectors, and particularly the central contacts, constitute particularly delicate parts.

In particular, these central contacts may very easily be damaged when, at the time of connection, the axes of the connector elements are not aligned.

Thus, when there is an angular offset between the connector elements which are being connected, the male central contact engages crookedly in the female central contact which, owing to the forces applied to bring the connector elements closer together, may lead to the central contacts being destroyed.

Such annular offsets often arise in practice and often the connector elements have to be coupled blind, for example when one of the connector elements, made in the form of a base, is housed at the bottom of a cavity formed in an item of equipment, the other connector element, made in the form of a plug, being fitted at the end of a coaxial cable to be connected.

Such a case arises, for example, when fitting an additional card, such as a PCM-CIA card into a portable microcomputer, it being necessary for the card to be housed in a slot-shaped cavity of the microcomputer, and it being necessary for at least one of the connections between the card and the microcomputer to be made by means of a microminiature coaxial connector.

SUMMARY OF THE INVENTION

The present invention provides a microminiature coaxial connector, especially avoiding the drawback mentioned previously of coaxial connectors of this known type.

The coaxial connector according to the invention is essentially characterized in that the second connector element includes a cylindrical skirt forcibly fitted into the cavity of its body, said skirt extending beyond the forward end of said body, and the distance between the end of said skirt and the end of the central contact of said second connector element being substantially equal to the distance between the end of the body of the first connector element and the end of the central contact housed within this body.

Thus, at the time of connection, and practically simultaneously with the start of mutual engagement of the central contacts, the end of the skirt of the second connector element starts to bear on the forward end of the body of the first connector element and, in the case where the axes of the connector elements being coupled are not aligned, a mutual realignment of the connector elements is achieved, the skirt projecting from the body of the second connector element being guided by the interior wall of the end cavity of the body of the first connector element until the connector elements are locked together by engagement of the bead of the projecting barrel of the first connector element in the groove formed in the body of the second connector element.

Misaligned forces which, in the state of the art, are applied to the central contacts, are taken up, according to the invention, by the socket of the second connector element bearing against the wall of the body of the first connector element. These parts are relatively thick and have much higher rigidity than the central contacts so that neither these parts nor the central contacts risk becoming damaged.

The skirt of the second connector element may be fitted as a very tight fit in the cavity emerging at the forward end of the body of the second connector element or, as an alternative, may be crimped into this cavity.

In a particularly advantageous manner, the skirt includes a tapering surface in the region of the rear end of its interior wall, this surface defining, together with a tapering surface directed in the opposite direction made in the interior wall of the body of the second connector element, the groove for receiving, by snap-fastening, the bead of the elastic socket of the first connector element. It is thus not necessary to machine a groove into the wall of the body of the second connector element, such a machining operation being otherwise particularly difficult owing to the small dimensions of the connector.

To make it easier for the skirt of the second connector element to bear on and be guided in the body of the first connector element, the frontal end of the exterior wall of the skirt and/or the frontal end of the wall of the body of the first connector element have a tapering surface.

For the purpose of making the invention easier to understand, one particular embodiment thereof will now be described by way of non-limiting example with reference to the appended drawing in which:

DETAILED DESCRIPTION OF THE INVENTION

Figure 1:
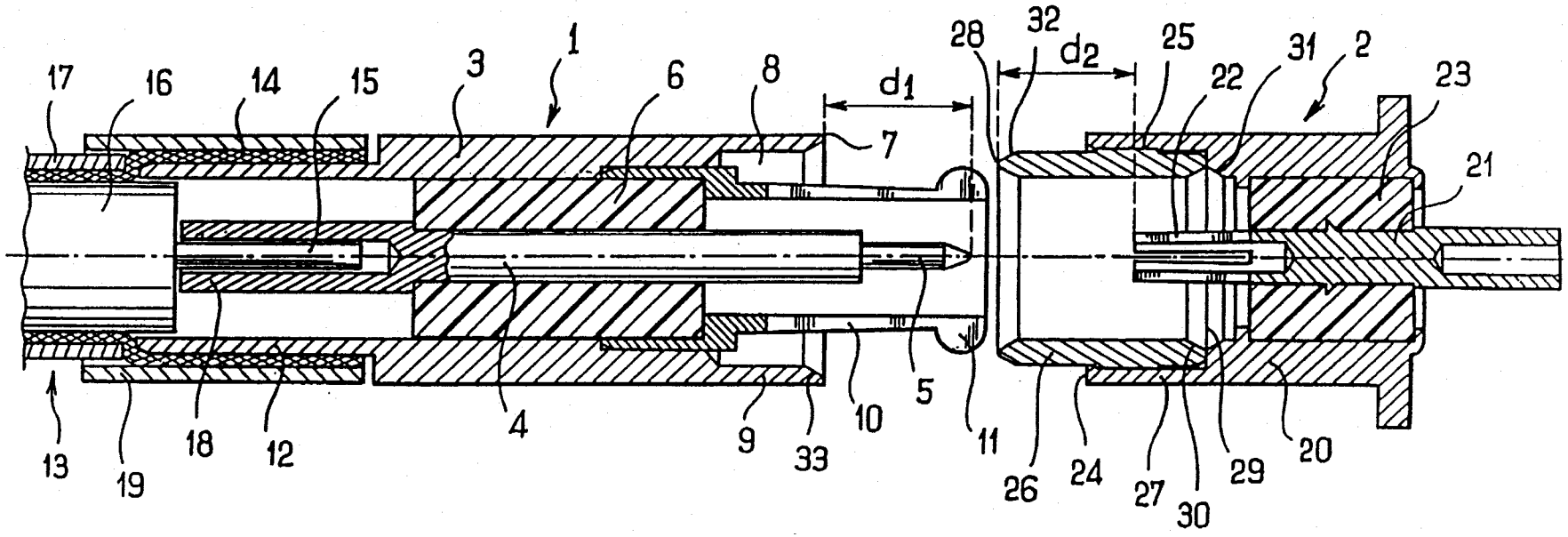
FIG. 1 represents a coaxial connector according to the invention, in section, before coupling.

The connector illustrated in the drawing includes a first connector element denoted overall by 1, and which in the example illustrated is arranged as a male plug, and a second connector element denoted overall by 2, and which is arranged as a female socket.

The first connector element 1 (male) includes a conductive cylindrical body 3, which is hollow, forming an exterior earthing contact, a central contact 4 ending in a pin 5, and an insulator 6 interposed between the central contact 4 and the body 3.

The body 3 has an open forward end 7 in which a cavity 8 is formed, the wall 9 of the body in the region of the cavity 8 constituting a cylindrical skirt.

The central contact 4 projects from the forward end 7 of the body 3 and the end of the pin 5 of the central contact is located at a distance d1 from the forward end 7 of the body 3.

The connector element 1 further includes an elastic socket 10, which is split to give it radial elasticity, said elastic socket 10 including, close to its free end projecting from the body 3, an annular peripheral bead 11.

The free end of the socket 10 is very slightly forwards of the frontal end of the pin 5.

The body 3 of the first connector element 1 includes, at its rear part, a shank 12 onto which is fastened the end of a coaxial cable denoted overall by 13, of conventional structure, including a conducting exterior braid 14, a conducting core 15, an insulator 16 interposed between the core 15 and the braid 14, and a protective outer sheath 17.

The bared end of the core 15 is engaged in a shank 18 at the rear end of the central contact 4 of the connector element 1 and the bared end of the braid 14 is immobilized on the shank 12 of the body 3 of this connector element by an external sleeve 19.

The second connector element 2 (female) includes a hollow cylindrical conducting body, forming an exterior earthing contact, 20, a central contact 21 ending at the front in a female contact socket 22 which complements the pin 5, and an insulator 23 interposed between the exterior body 20 and the central contact 21.

Like the body 3 of the first connector element 1, the body 20 of the second connector element 2 has an open end 24 to which a cavity 25 is formed.

According to the invention, a skirt 26 is forcibly fitted into the cavity 25, either by means of a very tight fit as illustrated, or by crimping the wall 27 of the body 20 which, in the region of the cavity 25, constitutes a cylindrical skirt into which the skirt 26 is engaged.

The forward end 28 of the skirt 26, relative to the end of the central contact socket 22, is located at a distance d2 equal to the distance d1 defined on the connector element 1 between the forward end 7 of the body 3 and the end of the central contact pin 5.

The second connector element 2 includes a groove 29 intended to receive, by snap-fastening, the bead 11 of the elastic socket 10 projecting from the body 3 of the first connector element 1.

This groove 29 is formed by two opposed tapering surfaces or chamfers 30, 31 formed respectively in the region of the rear end of the interior surface of the skirt 26, and in the interior wall of the body 20 close to the rear end of the cavity 25 of the latter.

In the example illustrated, tapering surfaces 32 and 33 are also made at the frontal end of the skirt 26 on the outside, and if necessary on the inside of the latter and respectively at the end of the wall 9 of the body 3 on the interior face of this wall.

Figure 2:
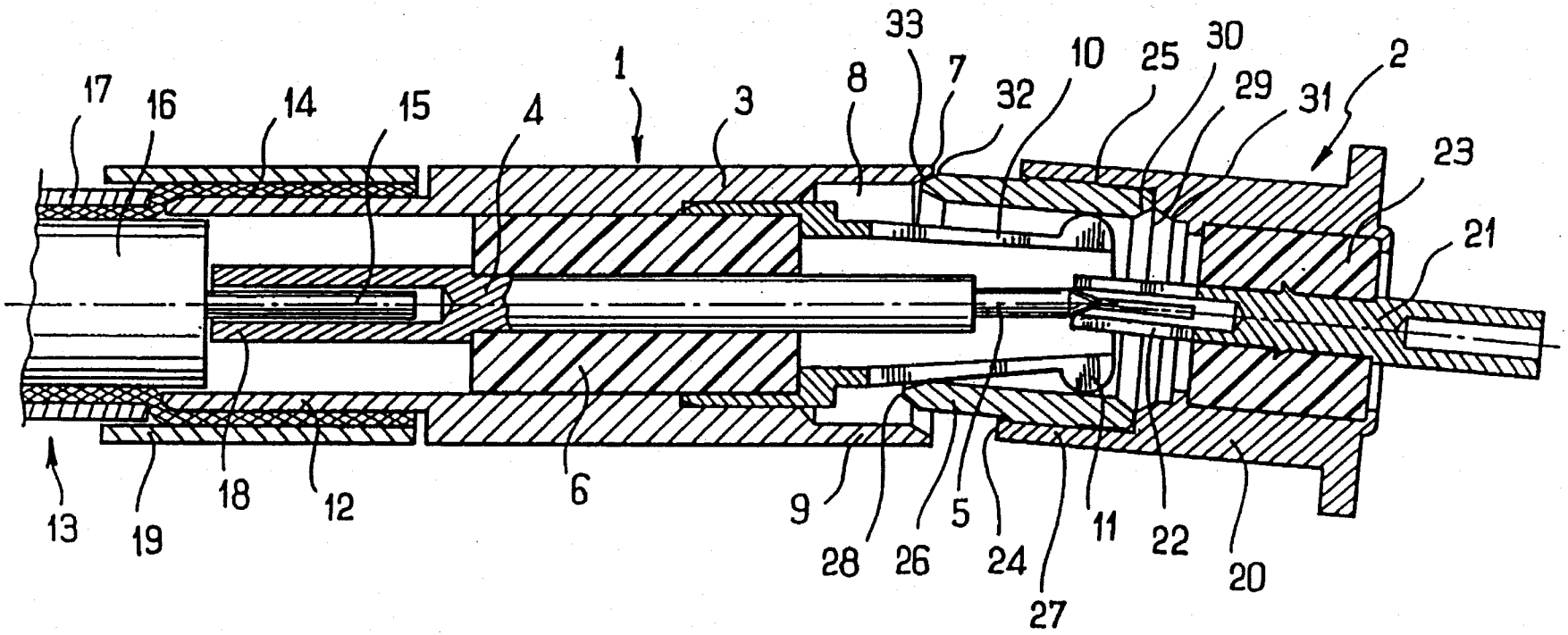
FIG. 2 illustrates the connector of FIG. 1 in the process of coupling.
Figure 3:
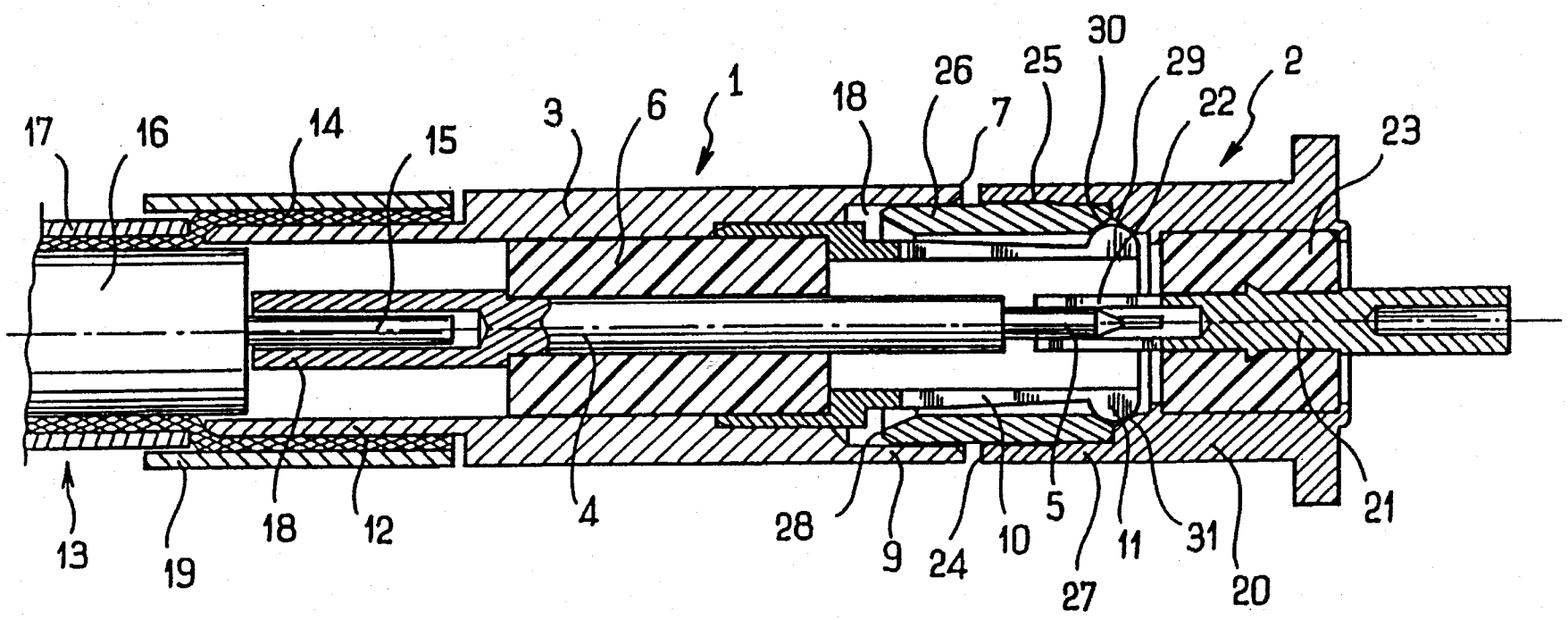
FIG. 3 illustrates this same connector in the coupled state.

It will be understood, from FIG. 2 that, at the time of coupling the two connector elements 1 and 2, starting from an uncoupled position, illustrated in FIG. 1, when, as illustrated, the connector element 2 is at an angle of inclination (which may in practice be of the order of 5° to 10°) relative to the connector element 1, then at the start of engagement of the pin 5 into the socket 22, the end of the skirt 26 will come into contact with the end 7 of the body 3 of the connector element 1. After realignment of the connector elements, the skirt 26 will slip along the wall of the cavity 8, so that coupling may be continued without the risk of damaging the central contacts as far as the coupled position illustrated in FIG. 3 in which the bead 11 has become engaged in the groove 29 by snap-fastening.

Although the invention has been described in conjunction with a particular embodiment, it is quite obvious that it is in no way limited thereto and that various alternatives and modifications can be made to it without in any way departing either from its scope or its spirit.

In particular, although in the example illustrated the first connector element is of male type, and the second connector element is of female type, it is possible to arrange the first connector element as a female element and the second connector element as a male element.

I claim:

1. A microminiature coaxial connector which locks by snap-fastening, said microminiature coaxial connector including two complementary electrical connector elements, each of said electrical connector elements comprising: a hollow cylindrical body forming an exterior earthing contact, said body having a forward end and an interior wall, each of said connector elements further having, starting from said forward end, a cavity into which there penetrates a central contact, said central contact having an end, said two connector elements respectively having male and female central contacts, retained in the body via an insulating material, a first of the connector elements including, inside its body, an elastic socket surrounding its central contact and extending beyond the forward end of the body, said socket having a free end and including, close to its free end, substantially in line with the end of the central contact which it surrounds, a peripheral bead extending outwardly from said elastic socket and being able to engage in a groove formed in the interior wall of the body of a second of the connector elements, when said first connector element is inserted into said second connector element, wherein the second connector element includes a cylindrical skirt forcibly fitted into a cavity of said body of said second connector element, said skirt having an interior wall and an end and said skirt extending beyond the forward end of said second connector element body, the end of said skirt being at a distance (d2) from the end of the central contact of the said second connector element substantially equal to the distance (d1) between the end of the body of the first connector element and the end of the central contact housed within said second connector element body, and wherein said skirt includes a tapered surface in a region of a rear end of its interior wall.

2. A connector according to claim 1, wherein the skirt of the second connector element is tightly fitted in the cavity emerging at the forward end of the body of the second connector element.

3. A connector according to claim 1, wherein said tapered surface defining, together with another tapering surface directed in the opposite direction formed in the interior wall of the body of the second connector element said groove for receiving, by snap-fastening, the bead of the elastic socket of the first connector element.

4. A connector according to claim 1, wherein the forward end of the exterior wall of the skirt of the second connector element and the forward end of the wall of the body of the first connector element have a tapering surface.

5. A connector according to claim 1, wherein the forward end of the wall of the body of the first connector element has a tapering surface.

* * * * *